United States Patent [19]

Arioli et al.

[11] Patent Number: 4,560,099

[45] Date of Patent: Dec. 24, 1985

[54] FOLDING DEVICE FOR MACHINES FOR TREATING FOLDED FABRICS, PARTICULARLY PRINTED FABRICS

[75] Inventors: Amedea Arioli; Lorenza Arioli, both of Como, Italy

[73] Assignee: Arioli & C. S.r.l., Varese, Italy

[21] Appl. No.: 652,828

[22] Filed: Sep. 20, 1984

[30] Foreign Application Priority Data

Oct. 7, 1983 [IT] Italy ..... 23203 A/83

[51] Int. Cl.[4] ..... B65H 17/42

[52] U.S. Cl. ..... 226/105; 226/119; 8/149.3; 68/5 D

[58] Field of Search ..... 226/105, 104, 119, 189; 242/55.01; 223/37, 38; 28/182; 8/149.3; 68/5 C, 5 D, 158

[56] References Cited

U.S. PATENT DOCUMENTS

| | | | |
|---|---|---|---|
| 1,494,307 | 5/1924 | Hinnekens | 226/105 |
| 1,755,006 | 4/1930 | Hurxthal | 226/105 |
| 1,990,406 | 2/1935 | Hurxthal et al. | 226/105 |
| 4,393,532 | 7/1983 | Sando et al. | 8/149.1 |

*Primary Examiner*—Leonard D. Christian

*Attorney, Agent, or Firm*—Hedman, Gibson, Costigan & Hoare

[57] ABSTRACT

A folding device for a machine for treating, particularly steaming, folded printed fabrics is described. The device is constituted essentially by a rotary arm lift (S) which lifts individual support rods (20) for the folded fabric in succession from a condition in which the rods are suspended from endless conveyor chains (10) to a condition in which the rods (20) rest on rails (28) located above the active passes (16) of the chains, which draw the rods (20) carrying the folded fabric (F) through the treatment chamber (1) of the machine.

6 Claims, 6 Drawing Figures

1
2
4
5
6
7
8
9
10
12
13
14
15
16
17
18
19
20
24
26
28
60
S

FOLDING DEVICE FOR MACHINES FOR TREATING FOLDED FABRICS, PARTICULARLY PRINTED FABRICS

The present invention relates to a folding device for machines or apparatus for treating folded fabrics. More particularly, but not exclusively, the invention relates to a folding device for machines or apparatus for steaming printed fabrics.

A machine for treating (for example, preparing, steaming, dyeing, finishing, improving and the like) folded fabrics generally includes a treatment chamber in which an endless conveyor is supported for transferring the fabric to be treated from an inlet side of the chamber, where a roller for supporting and feeding the fabric operates, to an outlet side of the treatment chamber.

Such a conveyor is constituted by a pair of endless chains supported and located close to the longitudinal walls of the chamber, the active and return passes of the chains extending close to the top and the bottom of the chamber respectively.

A plurality of rollers, termed rods in the art and in the following description, have ends connected mechanically to opposing links of the chains and are used to support the folded fabrics within the treatment chamber.

Generally a conveyor of the said type is advanced stepwise both to allow the formation of successive folds of fabric on successive rods close to the inlet side and to provide the necessary dwell time for the folded fabric in the treatment chamber.

In order to form the folds, folding devices with various operational and structural characteristics are used which, in most cases, operate between the roller for supporting and feeding the fabric and the first rod downstream of this roller in the direction of movement of the conveyor. In general the function of strating the formation of the fold is entrusted to these devices and the fold is then completed by gravity.

For this purpose the folding devices press on the portion of fabric between the feed roller and the first rod for a limited period of time until the fold being formed has reached a certain size (length) and then, for safety, follow the fold during formation until it is completed.

The formation of folds by direct contact of a folding device with the textile is acceptable and even advantageous from various points of view as long as printed fabrics are not to be treated (for example steamed). In this case, indeed, the contact may cause the formation of defects which although more or less evident are always unacceptable in printed designs and result in wastage of material.

Since the formation of folds is basically for reasons of economy of space and operation of the machine, in the case of the treatment (for example steaming) of printed fabrics it is necessary for these to be manipulated on the non-printed part (reverse side) to form the folds.

For this purpose a conveyor has been proposed and widely used in which:

the distance of the first rod of the active pass from the roller for supporting and feeding the fabric in the treatment chamber is such as to allow the formation of a fold as a result solely of the weight of the fabric (open fold or fold with spaced apart drapes) and in which:

there is formed a portion which is upwardly inclined in the direction of movement of the conveyor, extending from a low position, upstream of the roller for feeding the fabric (or at least of the first drape of the open fold) to a high position adjacent the first rod.

At the beginning of such inclined section, the rods encounter the reverse side of the printed fabric. At that moment, or immediately before, a device is operated which unhooks the rods from the chains of the conveyor, drives them along the inclined section, accelerating their movement, and re-hooks them on the chains at the beginning of the upper active portion thereof.

Thus, while the open fold under consideration is closed (drapes brought together) a new open fold is formed in the space between the roller for feeding the fabric and the beginning of the active pass of the conveyor.

A first considerable disadvantage of this method resides in the fact that it takes up a wide initial portion of the chamber for treating the fabric. Consequently this treatment chamber has a considerably smaller useful capacity than the volume available.

A second disadvantage lies in the incomplete reliability in operation of the said device for unhooking, accelerated driving and re-hooking of the rods. Defective operation of this device may require the stoppage of the machine as well as of the entire production line in which it is incorporated.

Furthermore such a device has a complex structure which is difficult and laborious to put into operation and requires frequent control and maintenance.

The problem at the root of the present invention is that of providing a folding device for machines for treating fabrics, particularly for machines for steaming printed fabrics, having structural and functional characteristics such as to overcome the disadvantages mentioned above with reference to the prior art.

This problem is solved according to the invention by a folding device for a machine for treating folded printed fabrics, including a treatment chamber, a conveyor including a pair of endless chains and a plurality of rods carried by the chains, the active passes of the chains extending in the chamber between an inlet and an outlet for the fabric, characterised in that each rod is suspended from opposite links of the respective conveyor chains by means of a pair of arms hinged to opposite respective links of the chains and to opposite respective ends of the rod, and in that the device further includes a pair of straight rails extending above and parallel to the active passes of the chains, at least one lift with arms rotatable about an axis parallel to the rods, supported upstream of the rails in a position overlying the active passes of the chains, the lift arms describing substantially circular paths which interfere with the individual rods in succession when the rods are suspended by their arms from the said chains upstream of the rails, to lift successive rods from the suspended condition to a condition of resting on the rails.

Further characteristics and advantages of the invention will become clearer from the detailed description of one embodiment thereof, made with reference to the appended drawings given purely by way of non-limiting example in which.

Figure 1:
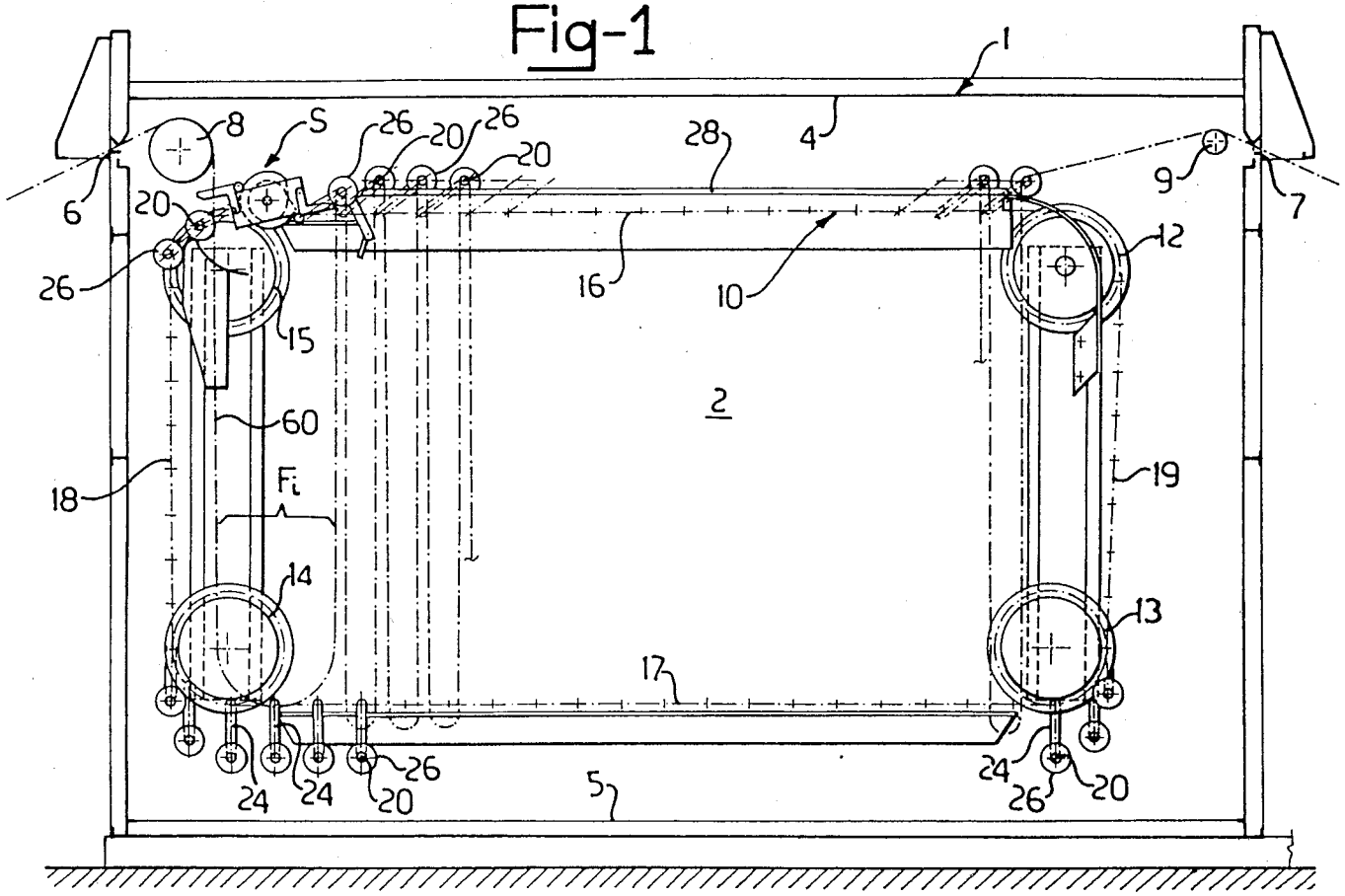
FIG. 1 is a schematic longitudinal sectional view of a machine for treating fabrics incorporating a folding device according to the invention.

With reference to the drawings, a machine for treating folded fabrics, particularly for steaming printed fabrics, includes a parallelepiped shaped chamber 1 the longitudinal walls of which are indicated 2,3 and the top and the bottom are indicated 4 and 5, respectively, the chamber having at its front end an inlet aperture 6 for the fabric to be treated and at its rear, upper end an outlet aperture 7 for the treated fabric.

In correspondence with the aperture 6 a roller 8 is rotatably supported in the chamber 1 for supporting and feeding the fabric, and an idle roller, indicated 9, for supporting the fabric is located close to the outlet aperture 7. Both the rollers 8, 9 have horizontal axes perpendicular to the walls 2, 3.

A conveyor (T) is supported in the chamber 1 and is constituted essentially by a pair of endless chains 10, 11 of conventional type used in the art and schematically indicated in chain line in the appended drawings.

The chain 10 is supported and located close to the longitudinal wall 2 by respective sprocket wheels 12, 13,14 and 15 all with their axes horizontal and perpendicular to the said wall. The wheel 12 supported close to the outlet aperture 7 is a drive wheel. The upper active pass 16 of the chain 10 extends horizontally between the inlet and outlet openings 6, 7 for the fabric and in a position underlying these while the lower return pass 17 extends horizontally close to the bottom 5 of the chamber.

Reference 18 indicates the front ascending pass of the chain 10, which extends vertically in correspondence with the roller 8 for feeding the fabric and reference 19 indicates the rear vertical descending pass of the chain.

The chain 11 is identical to the chain 10 and is similarly supported close to the longitudinal wall 3 of the chamber 1. All the parts relative to the chain 11 have the same reference numerals as those for the chain 10 with the addition of the suffix a.

In the description below and in the subsequent claims the terms upstream, downstream are used with reference to the direction of movement of the chains 10 and 11.

Figure 2:
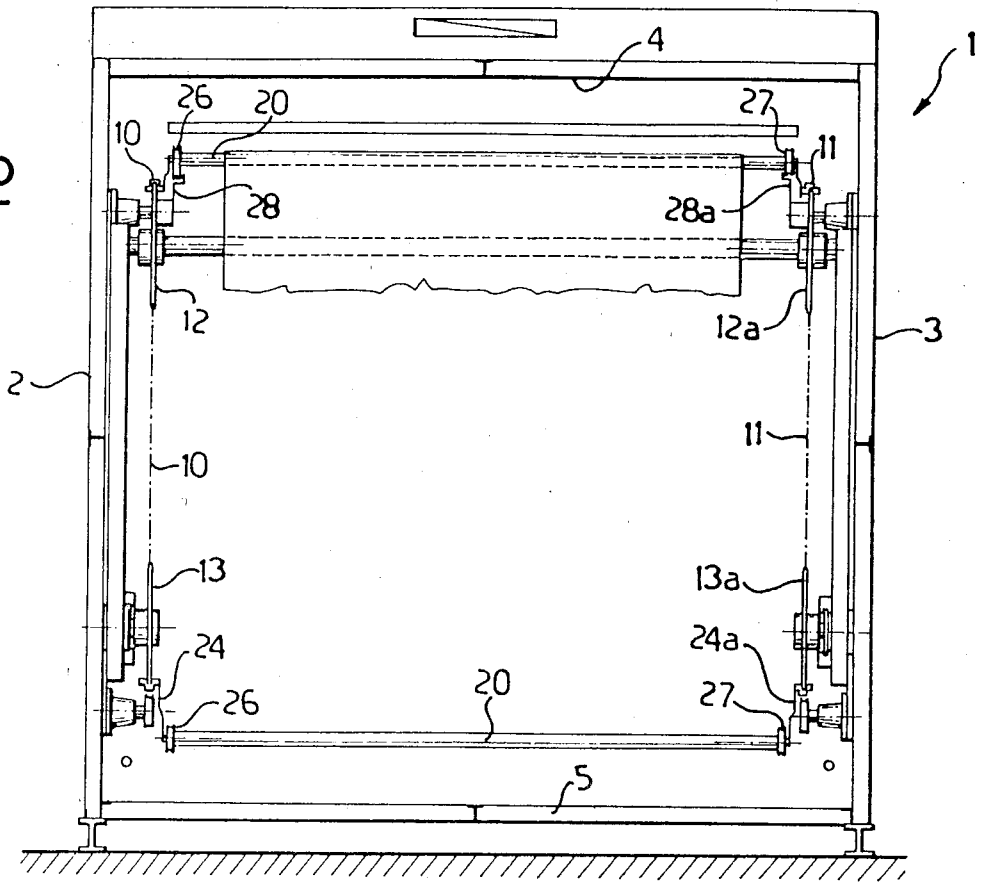
FIG. 2 is a schematic cross-sectional view of the machine of FIG. 1.
Figure 3:
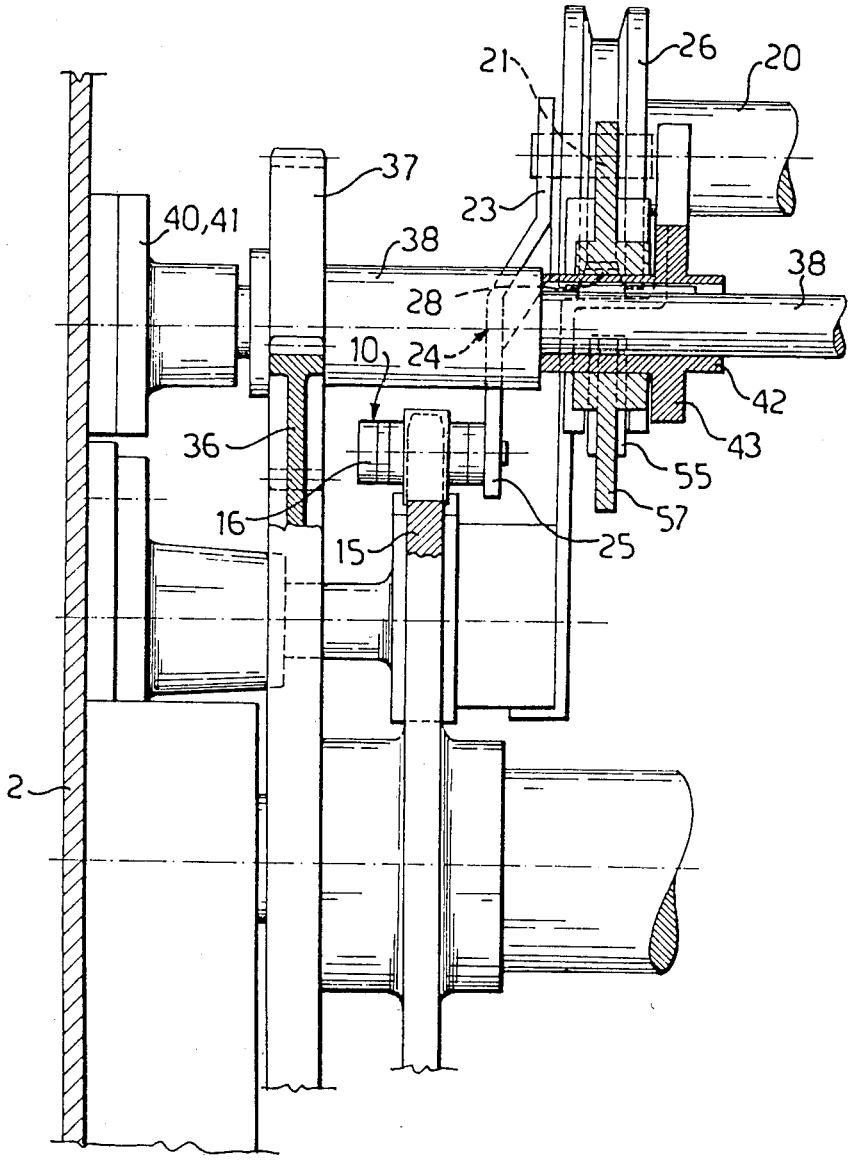
FIG. 3 is a sectional view of a detail of the machine of FIG. 2, on an enlarged scale.

Reference 20 indicates each rod of a plurality of rods for supporting the folded fabric, each rod having opposite ends connected mechanically to opposing links of the chains 10, 11. In particular (FIGS. 2, 3) each rod 20 has pins 21,22 at opposite ends on which the ends **23, 23*a* of arms 24, 24*a* are rotatably mounted, the opposite ends 25, 25*a* of these arms being rotatably mounted on opposing links of the chains 10, 11. Under normal conditions, each rod 20 is thus suspended from opposite points on the chains 10, 11**, being freely rotatable in one sense or in the opposite sense about these points.

On the pins 21,22 of each rod 20 respective rollers 26, 27 are rotatably mounted for engaging, in the manner described below, respective upper rails **28, 28*a* and lower rails 29, 29*a*. The upper rails 28, 28*a* extend above the active passes 16, 16*a* of the chains 10, 11 from which they are spaced by distance less than the length of the arms 24** and preferably equal to about half this length.

In correspondence with the upper upstream sprocket wheel 15 and on the side thereof facing inwardly of the chamber 1 there is supported (by conventional means not shown) a plate 30 disposed vertically and in a position facing the sprocket wheel 15 in question. The plate 30 has a front edge 31 with a vertical section 32 extending close to the ascending portion 18 of the chain 10 on the inner side of this chain. The upper end 33 of the portion 32 of the front edge 31 is at a level above the horizontal line passing through the centre of the sprocket wheel 15 and is connected to a descending curved edge 34 preferably passing through the centre of the wheel 15 and extending close to the periphery thereof. The width of the edges 31 and 34 (that is to say the dimension of these edges measured in a direction perpendicular to the plate 30) suffices to guide the roller 26 of each rod 20, as will become clearer from the description below. In correspondence with the front upper wheel **15*a* there is also supported a further plate similar to and symmetrical with respect to the plate 30** described above. This further plate with its vertical and curved edges is not shown, to simplify the drawings.

Between the sprocket wheel 15 and the wall 2 of the chamber 1 is a gear wheel 36 rigid with the sprocket wheel 15 for rotation therewith and meshing with a pinion 37.

The pinion 37 is keyed to a horizontal shaft 38 rotatably supported conventionally by supports 40,41 fixed to the opposite longitudinal walls 2,3 of the chamber 1. The gear ratio between the gear wheel 36 and its pinion 37 is 4:1.

A hub 42 on a rectangular plate-shaped body 43 is keyed to the shaft 38 close to the pinion 37, the body 43 being parallel to the wall 2 and adjacent the inside surface of the upper rail 28.

The plate-shaped body 43 has pins 44, 45 (FIG. 4) on its opposite sides on which are rotatably mounted the short arms 46, 47 of two similar cranked levers 48, 49, the larger ends of which extend outwardly of the plate-shaped body 43 and are indicated 50,51.

Each of the cranked levers 48, 49 has a lug 52,53 which is effectively an elongation of the respective longer arm 50,51 and on the opposite side thereof. These lugs 52,53 are bifurcated and support respective cam-follower rollers 54,55. The rollers 54,55 are in rolling contact with the profile 56 of a fixed cam 57 mounted coaxially about the shaft 38 but structurally independent thereof. The profile 56 of the cam 57 includes a circular portion which subtends an angle of 270° at the centre of the cam and faces the edge 34 mentioned above (FIGS. 4–6) and a sharply re-entrant portion, indicated 58, facing the rail 28.

The plate-shaped body 43 and the respective cranked levers 48 and 49 driven by the cam 57 together constitute a rotary arm lift S rotating about the axis of the shaft 38 and driven by the drive wheel 12 through the gear transmission comprising the gear wheel 36 and the pinion 37.

A lift S' entirely similar to that described above is mounted on the shaft 38 close to the longitudinal wall 3 of the treatment chamber 1. All the components of this second lift S' are identified by the same reference numerals as those of the components of the lift S with the addition of the suffix a. It should be noted that the distance between the roller 8 for supporting and feeding the fabric at the inlet and the first rod 20 of the active pass of the conveyor T is equal to or slightly greater than the size of the lift S measured in the direction of movement of the conveyor itself.

During the treatment for example steaming, the printed fabric fed into the chamber 1 by the feed roller 8 is supported in a folded disposition F by the rods 20 which pass along the upper pass **16-16*a* of the conveyor, this conveyor being advanced stepwise in an entirely conventional manner. At the end of the upper pass 16-16***a* the fabric is taken up, again by a conventional method, and discharged from the steaming chamber through the outlet aperture 7. Along the successive passes 19, 19*a* and 18, 18*a* of the conveyor the rods move in a suspended condition and in this same condition are raised through the front ascending passes 18, 18*a*, of the conveyor. Close to the upper end of these front passes 18, 18*a* the rollers 26, 27 of the rods 20 encounter the front edges 31–32 of the plates 30-30*a* which prevent the rods 20 from maintaining the normally suspended condition. The advancing step of the chains 10, 11 is such that, at each step, a rod 20 is held by the upper ends 33 of the edges 31, 32 of the plate 30.

Figure 4:
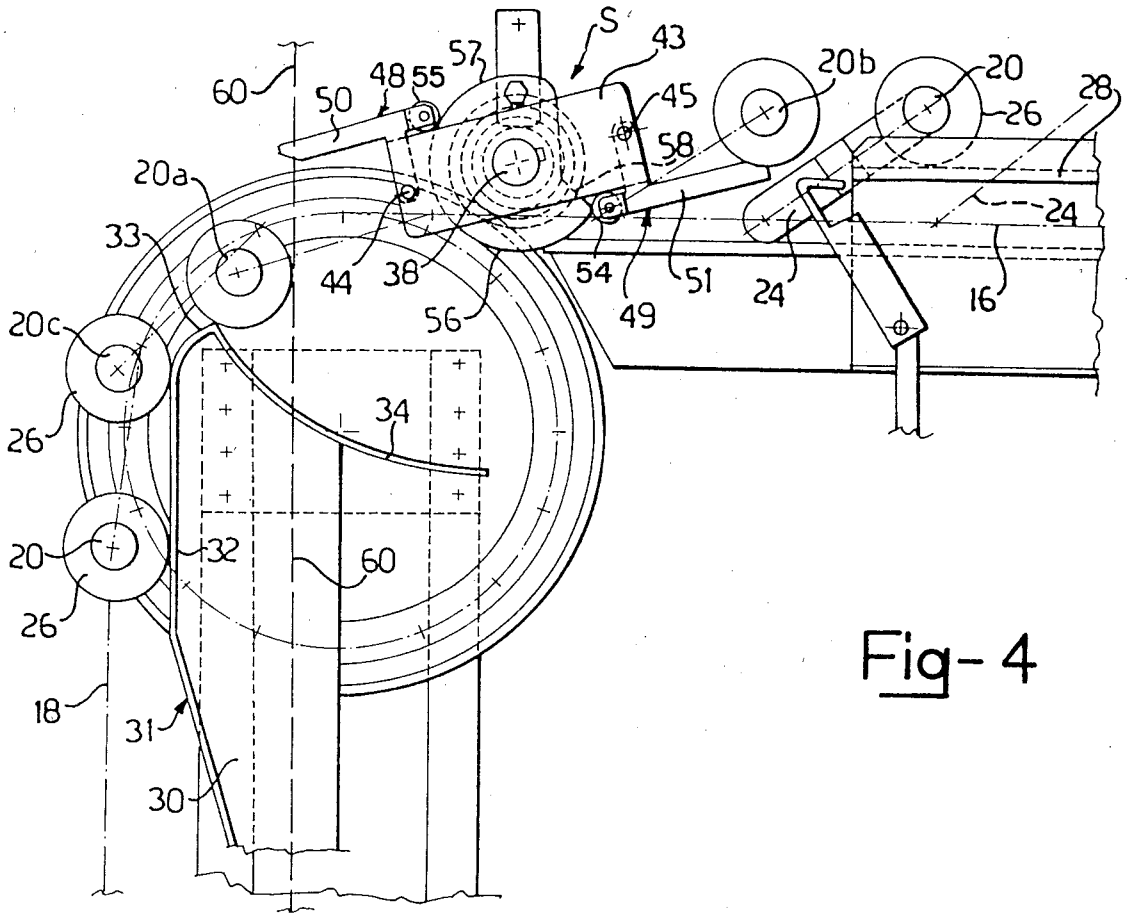
FIGS. 4, 5 and 6 are schematic views of an enlarged scale of part of a device according to the invention in successive stages of operation.
Figure 5:
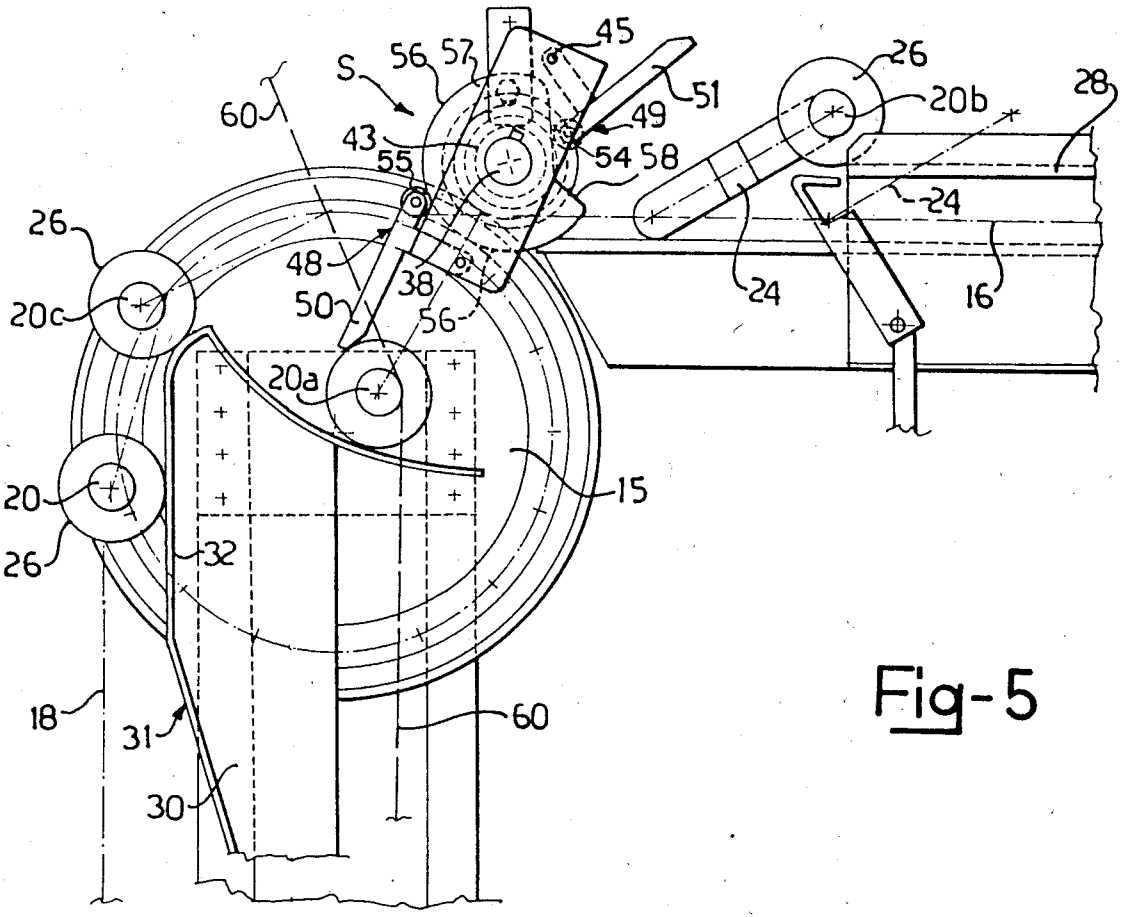
Figure 6:
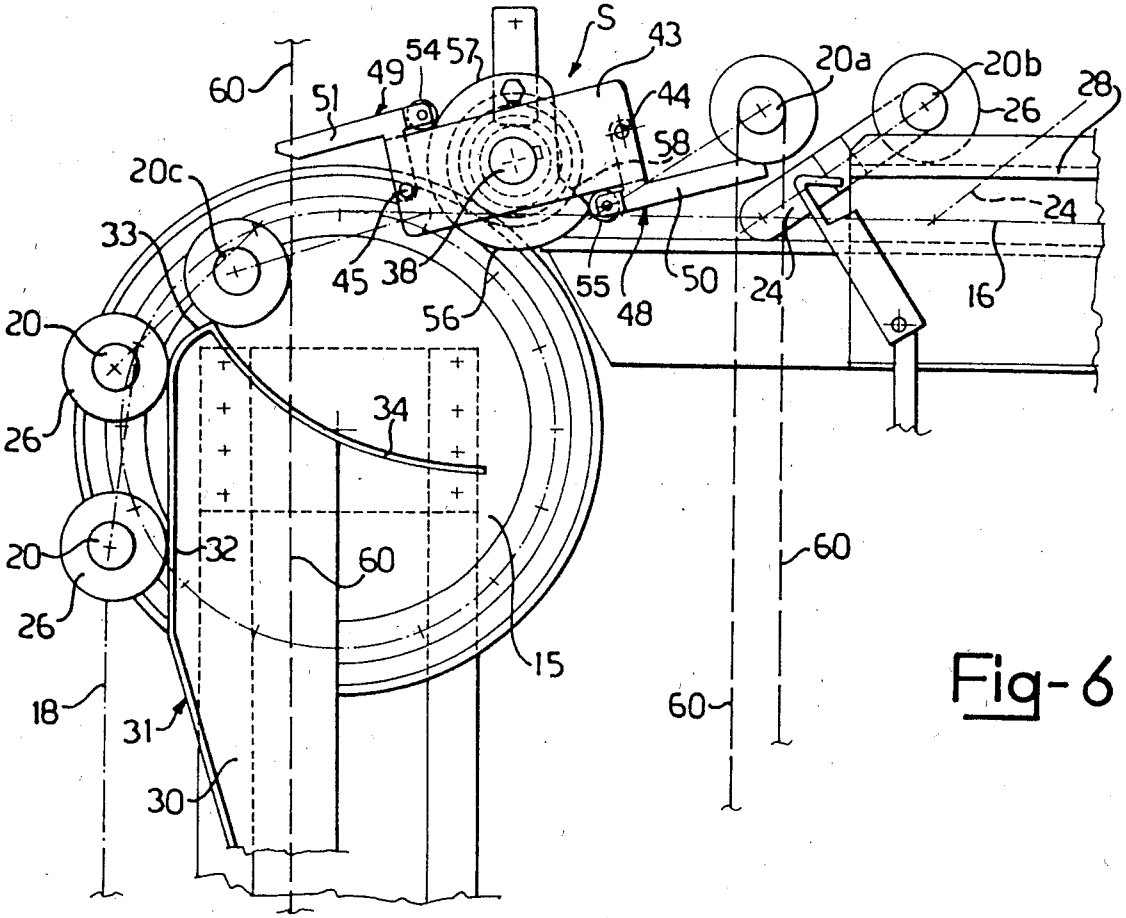

With reference to FIGS. 4–6 the operation of the lifts S, S′ will now be described. For simplification, the operation is described with reference to the single lift S and, hence, to the mechanisms and details described relative thereto. The operation of the lift S′ is entirely similar and symmetrical to that of the lift S.

In an initial condition, the conveyor T is stopped, a rod 20*a* is held by the upper end 33 of the edge 31–32 of the plate 30; a rod 20*b* is in the position immediately upstream of the upper rail 28 and is supported in this position by the arm 51 of the lever 49 of the lift S.

It should be noted that, in this position, the roller 55 of the lever 49 bears on the cam profile 56 at a point immediately preceding the re-entrant portion 58 of this profile. In the space between the roller 8 and the rod 20*b* an open fold Fi is formed, the front drape 60 of which hangs immediately downstream of the rod 20*a* with reference to the direction of advance of the conveyor T. Reference 20*c* indicates the rod which follows the rod 20*a* mentioned above and which is retained by the vertical section 32 of the edge 31 of the plate 30.

From this initial condition, the conveyor effects a stepwise advance while the fabric is continuously fed at a predetermined rate from the roller 8.

Upon such advance, the following movements occur *simultaneously:* the rollers 26,27 of the rod 20*a* roll along the curved descending edge 34, accompanied by a substantially pendulous movement of the rod 20*a* about the pivotal axis of attachment of its arms 24, 24*a* to the chains 10, 11. The rod 20*a* thrusts before it the front drape 60 of the open fold Fi which it contacts on the reverse side of the textile fabric (non-printed side);

the plate-shaped body 43 rotates through 180° about the axis of the shaft 38. The arm 50 of the crank lever 48 first follows the roller 26 of the rod 20*a* then, moving towards the end of the curved edge 34, comes into contact therewith and lifts it (and the entire rod 20*a* therewith) to the level of the rail 28, into a position close to the upstream end thereof;

the roller 55 of the cranked lever 49 passes over the re-entrant portion 58 of the cam 57. The cranked lever 49, as a result of the eccentric weight of the arm 51 rotates about its pivot pin 45 in a rotational sense contrary to the rotation of the plate-shaped body 43. Consequently the arm 51 does not interfere with the roller 26 of the rod 20*b* during the said rotations;

the rod 20*c* is moved into correspondence with the upper end 33 of the edge 31 by which it is held so as not to interfere with the arm 50 during the angular movement of the latter in following the roller 26 of the rod 20*a*.

At the end of these movements, while the fold Fi considered above is closed and is supported by the rod 20*a* which now occupies the initial position on the active pass of the conveyor, a new open fold has been formed between the roller 8 and this rod 20*a* and the lift S with all the mechanisms relative thereto has taken up initial positions identical to that considered above.

We claim:

1. A device for folding fabrics adaptable to a machine for treating printed fabrics, said device being housed in a chamber having an inlet and outlet for the fabric, comprising:

an endless conveyor within said chamber including two chains and spaced wheels for supporting said chains so as to define an active pass, a return pass and two vertical passes of said conveyor extending between said inlet and said outlet;

a plurality of rods for supporting the folded fabric and spaced from each other, each of said rods connected to said chains by means of a first pair of arms wherein said arms are hinged at one end to each of said chains and rotatably connected at the other end thereof to the end of said rod;

a pair of rails for supporting said rods, extending above and parallel to said active pass of said chains; and at least one rotary arm lift means supported upstream of said rails including means to intercept said rods hinged to said chains so as to lift successive rods with the fabric folded thereon to a position on said rails.

2. The folding device of claim 1, wherein said rotary arm lift means comprises a plate-shaped body supported for rotation about a shaft, a pair of cranked levers having short arms rotatably mounted on opposite ends of said body and long arms extending outwardly and normal to said short arms and said body, said cranked levers being driven by a cam mounted coaxially about said shaft, whereby said long arms describe a substantially circular path.

3. The following device of claim 2 wherein said cam includes a portion with a circular profile and a portion with a reentrant profile facing said rails.

4. The folding device of claim 2, wherein said long arms of said cranked levers are retractable.

5. The folding device according to claim 3, wherein two rotary arm lifts are provided to cooperate individually with said rails.

6. The folding device of claim 1, further comprising at least one plate in communication with one of said spaced wheels upstream of said rotary arm lift adapted to guide and position said rods for interception with said rotary arm lift.

* * * * *